United States Patent [19]

Faup et al.

[11] 4,114,731

[45] Sep. 19, 1978

[54] ELEVATOR SAFETY ARRANGEMENT

[75] Inventors: John Joseph Faup, Oradell; David Harvey Wolf, Ringwood, both of N.J.

[73] Assignee: Otis Elevator Company, New York, N.Y.

[21] Appl. No.: 675,021

[22] Filed: Apr. 8, 1976

[51] Int. Cl.[2] ..... B66B 5/02
[52] U.S. Cl. ..... 187/29 R
[58] Field of Search ..... 187/29

[56] References Cited

U.S. PATENT DOCUMENTS

| | | | |
|---|---|---|---|
| 3,584,706 | 6/1971 | Hall et al. | 187/29 |
| 3,587,785 | 6/1971 | Krauer et al. | 187/29 |
| 3,720,292 | 3/1973 | Magee | 187/29 |
| 3,741,348 | 6/1973 | Caputo | 187/29 |
| 3,961,688 | 6/1976 | Maynard | 187/29 |

*Primary Examiner*—Robert K. Schaefer
*Assistant Examiner*—W. E. Duncanson, Jr.
*Attorney, Agent, or Firm*—Robert T. Mayer

[57] ABSTRACT

An elevator safety arrangement for preventing further automatic movement of an elevator car upon the car exceeding a predetermined velocity when it is located within a predetermined distance of a landing at which a stop is to be made.

5 Claims, 4 Drawing Figures

ELEVATOR SAFETY ARRANGEMENT

Figure 1:
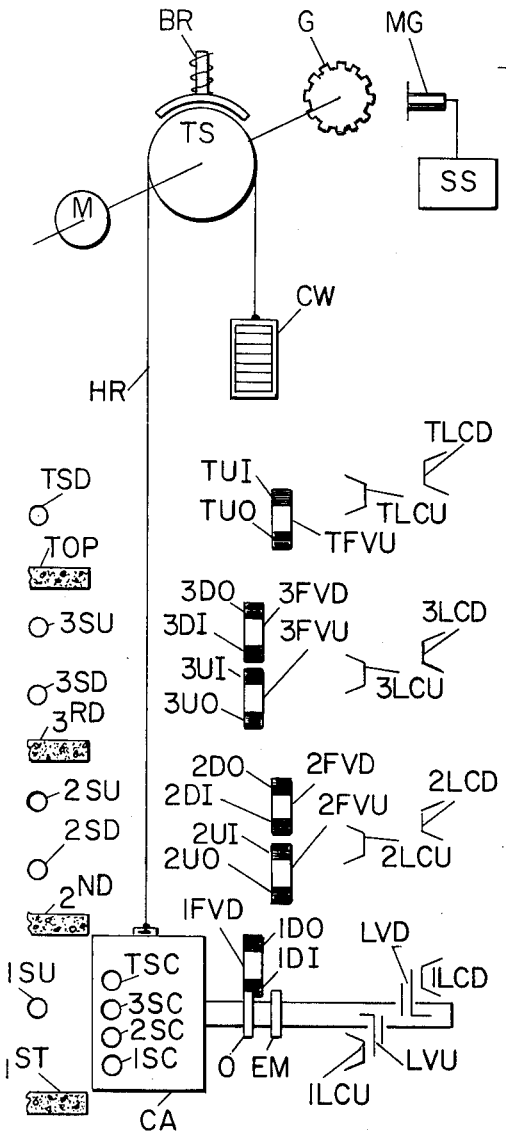

This invention relates to an elevator safety arrangement. More particularly, it concerns an arrangement for preventing automatic movement of an elevator car in response to predetermined conditions which are judged to be inconsistent with continued safe operation of the elevator car.

Known safety arrangements sense operational parameters such as car velocity. One known type of safety arrangement senses if car velocity in the down direction exceeds a predetermined maximum chosen to correspond with safe operating conditions of the elevator car at rated or full speed. These well-known safety arrangements include governors which cooperate with safety brakes on the elevator cars to prevent further automatic car movement in response to such overspeeding. Such a safety arrangement operates in response to such overspeeding regardless of the car's position or the condition of any of the other apparatus of the elevator system when such overspeeding occurs.

The foregoing arrangement is not operable during upward movement of an elevator car. Nor is it effective if the car starts to overspeed but strikes the buffer in the hoistway pit before exceeding a speed sufficient to operate the above arrangement. Consequently, another safety arrangement is typically provided to prevent elevator cars from crashing into the hoistway pit or the overhead. The function these arrangements provide is commonly referred to as the terminal slowdown operation. During approaches of an associated elevator car toward a terminal landing these arrangements operate in response to the car exceeding a predetermined velocity less than rated speed at a predetermined distance from a terminal. Such a condition is indicative of a failure of the elevator system to operate in its intended manner to decelerate the car in its approach to the terminal. In response to this condition, the apparatus providing terminal slowdown operates to decelerate the car independently of the control system equipment which would provide deceleration if the failure had not occurred.

Arrangements of the foregoing type provide protection to the passengers of elevator systems whether the cause of the formentioned condition is the failure of the control system to initiate a stopping operation for the terminal or the failure of the decelerating equipment of the system to respond to the initiation of a stopping operation for the terminal.

Other conditions, besides those mentiond above, are also considered to be inconsistent with continued safe operation. One such condition involves the operation of the car when the doors are open, allowing passengers to transfer.

A safety arrangement designed to provide protection under such conditions is disclosed in U.S. Pat. No. 3,587,785, issued June 28, 1971. This arrangement senses car velocity when the doors are open. If the car velocity exceeds a predetermined velocity under such circumstances the safety arrangement stops the elevator and applies the hoisting machine brake. Although this safety arrangement is intended to provide protection only while the elevator car is located at a landing with its doors open such that passengers can transfer to and from the car, its apparatus is so arranged that it operates to stop the car regardless of the location of the car provided the doors are open and the speed is above that considered safe for passenger transfer.

It is an object of this invention to provide an improved elevator safety arrangement.

It is a further object of this invention to disable the continued automatic movement of an elevator car when its velocity exceeds a predetermined magnitude during a stopping operation when the car becomes located within a predetermined distance of a selected landing.

The present invention provides a safety arrangement which responds to excessive car velocity upon the arrival of the car within a predetermined distance of a landing during a stopping operation to terminate automatic movement of the car. This anticipates conditions deemed to be inconsistent with continued safe operation by providing an early detection thereof.

Any safety arrangement which senses velocity must be designed for a velocity constraint which is consistent with the operational phase over which the safety arrangement is intended to be effective. If, like the first of the above mentioned arrangements, it is to be effective in response to the car traveling above rated speed, it must respond to velocities in excess thereof and consequently to velocities having a relatively large magnitude. Since the present invention is to be effective when the car is performing a stopping operation, it responds to velocities of a smaller magnitude.

In the preferred embodiment of the present invention a velocity sensing means cooperates with an auxiliary safety means. Initially this auxiliary safety means is in a deenergized state as the car begins interfloor movement and while it is traveling at rated speed. When the car subsequently decelerates to less than a predetermined velocity the auxiliary safety means is energized. Contacts controlled by the auxiliary safety means are connected with a main safety means. These contacts are arranged to be influential when the elevator car is within a predetermined distance of a landing at which a stop is to be made. If the auxiliary safety means indicates velocity above a pedetermined velocity when the car is within a predetermined distance of a landing at which a stop is to be made, the contacts connected with the main safety means cause it to disable the elevator control apparatus. Since this elevator control apparatus controls car movement, further automatic car movement is prevented.

Another feature of the preferred embodiment is that portions of the elevator control apparatus which are required for other well-known functions are advantageously used so that little additional equipment is required to implement the preferred embodiment. The portion so utilized is commonly referred to as the leveling equipment. In the disclosed embodiment, the leveling equipment indcludes leveling switches and inductor switches mounted on the car which respond to cooperating devices mounted in the hoistway. These switches cooperate with the elevator control apparatus to bring the car floor into register with selected landings at which stops are made. These switches also operate to provide a signal which indicates location of the car within a leveling zone. The preferred embodiment also utilizes this signal in implementing the safety arrangement which, consequently, becomes sensitive to velocity in excess of a predetermined velocity as the car enters the leveling zone. It will be appreciated however that the dimensions of the leveling zone do not necessarily define the zone in which the present invention operates and that variations in the relative operating distances of the leveling equipment and safety arrangement are possible.

Also, because indication of location in the leveling zone is so utilized, contacts controlled by the auxiliary safety means are connected in series with the car leveling switches. Since car movement is controlled by the leveling switches if the car is within the leveling zone, deenergization of the auxiliary safety means at such a time directly prevents any further car movement by disabling the car leveling switches. Since the leveling operation is independently disabled without requiring the assistance of the main safety circuit, this feature provides redundancy and improves the response time of the safety arrangement when deenergization of the auxiliary safety means occurs during the leveling operation.

A further feature of the preferred embodiment is that a memory means is provided to protect against the velocity sensing means failing to operate. The memory means is operated from a first to a second state by the velocity sensing means when a predetermined velocity is exceeded. The auxiliary safety means is arranged so it is energized only if the memory means is operated. Consequently, if the memory means is not operated, the auxiliary safety means remains in its deenergized state and prevents the control apparatus from providing automatic movement of the car as soon as it enters the leveling zone.

Another feature of the preferred embodiment operates to protect against a failure if contacts controlled by the auxiliary safety means fail to open because they are welded closed or otherwise malfunction. If this occurs the safety arrangement might respond as if the car velocity was always less than the predetermined velocity. Such a condition would defeat the purpose of the safety arrangement. Accordingly, the preferred embodiment is arranged to disable the control apparatus and prevent automatic movement if contacts of the auxiliary safety means do not operate to signify the deenergization thereof in response to the generation of signal for the elevator car to start interfloor trip.

In accordance with the present invention a safety arrangement is provided for an elevator control system which has control apparatus for automatically moving an elevator car between a plurality of landings and automatically stopping at any one of these landings upon the initiation of stopping operation for each respective landing. The safety arrangement includes a velocity sensing means producing at least a low and high speed signal in response to car velocity being less than and being in excess of a predetermined velocity, respectively. It also includes a distance sensing means producing a distance signal in response to each initiation of a stopping operation for each landing upon the car being located within a predetermined distance of the landing at which the stop is to be made. A disabling means is also included in the arrangement to operate in response to the simultaneous production of the high speed signal and the distance signal to render the control apparatus inoperable to move the elevator car automatically.

Figure 3:
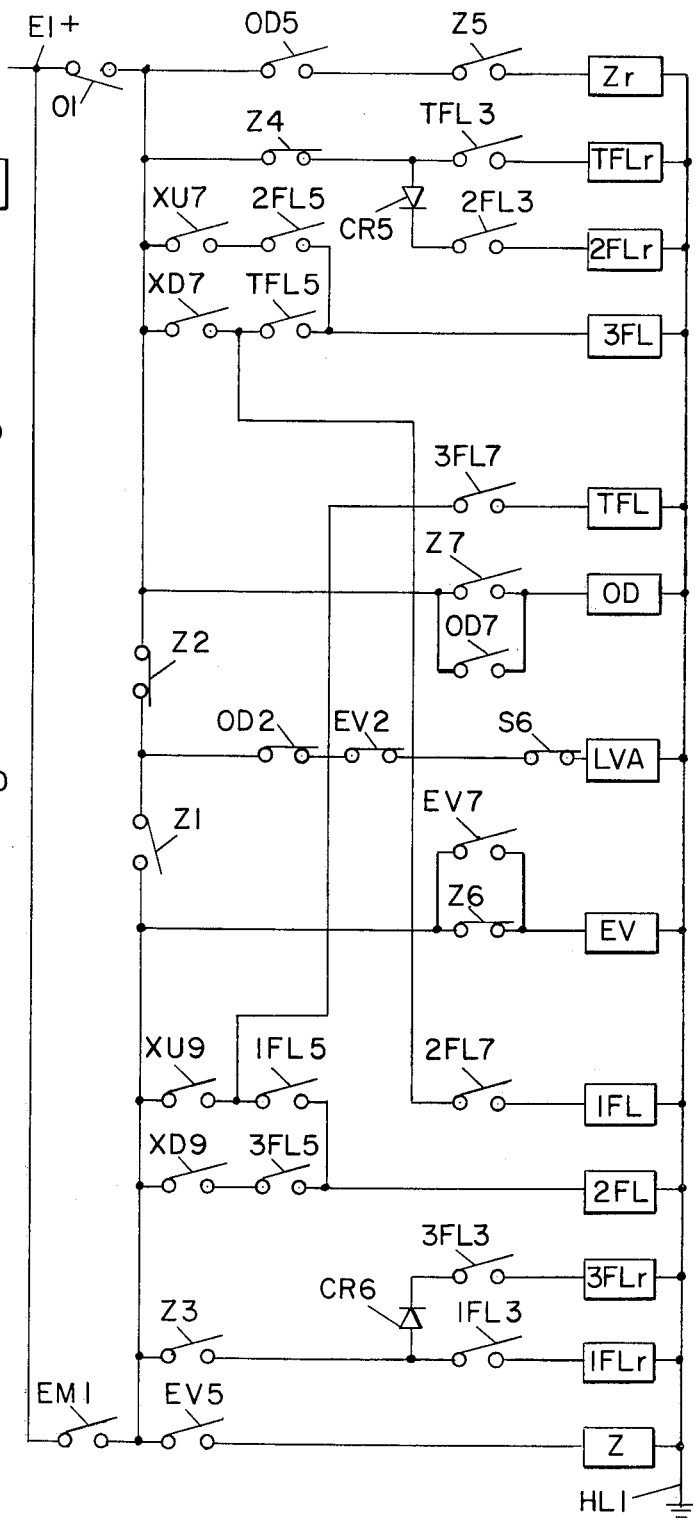
Figure 2:
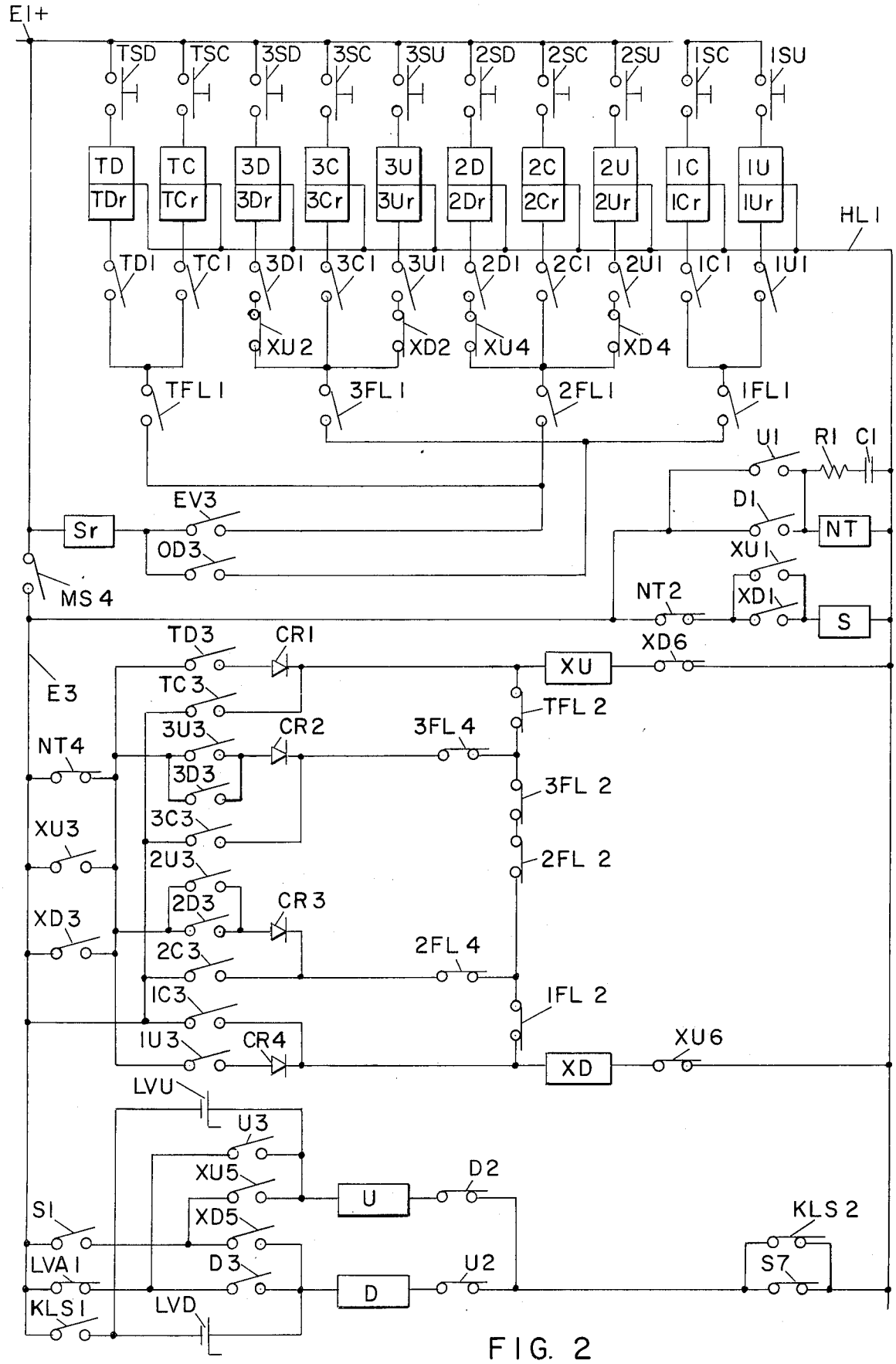
Figure 4:
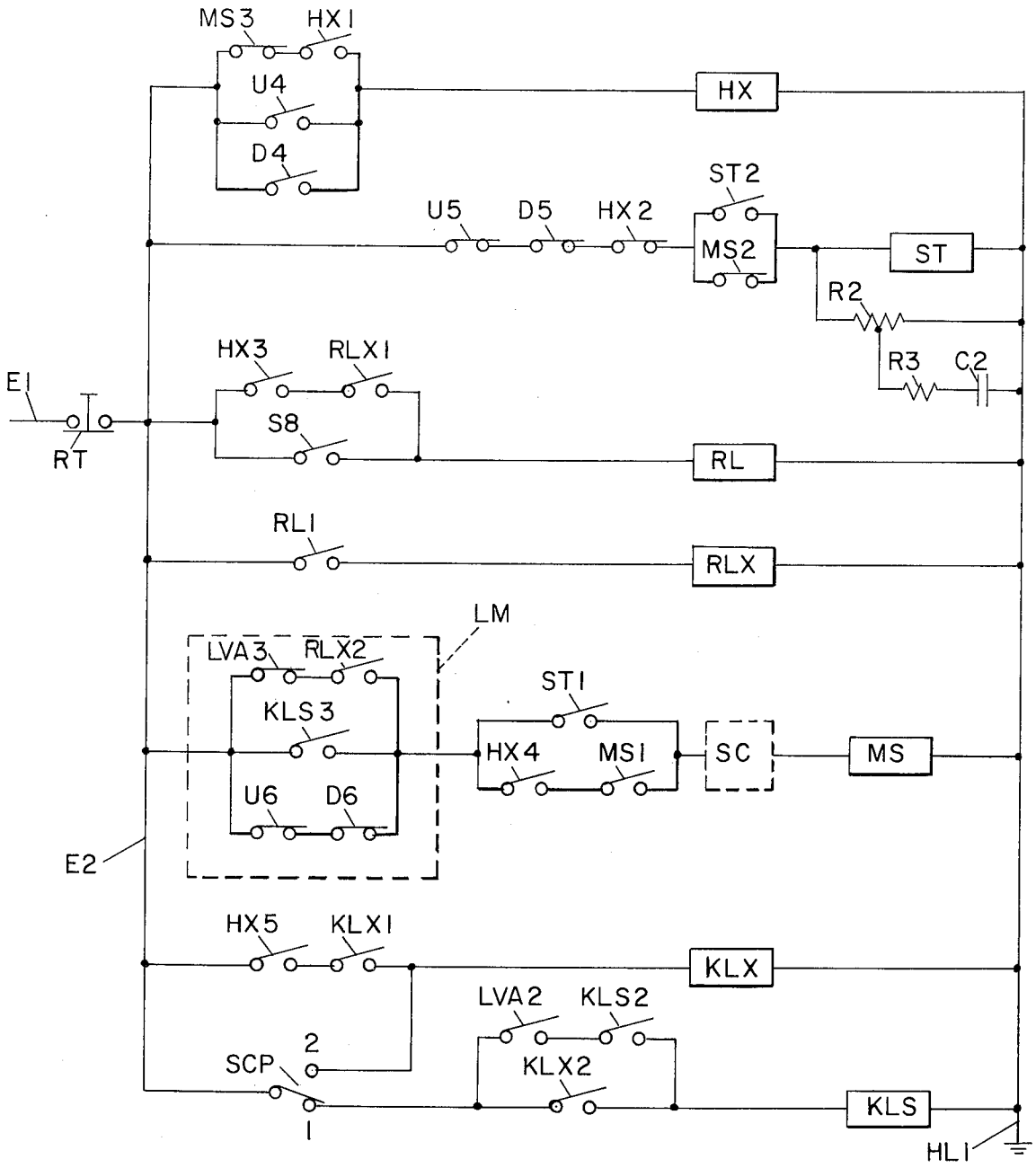

Other objects and features of the invention will be apparent from the foregoing and the following description when considered in conjunction with the appended claims and the accompanying drawing in which:

FIG. 1 is a simplified representation of parts of an elevator installation including an elevator car and a portion of its hoistway together with other associated equipment;

FIGS. 2 and 3 taken together constitute a simplified wiring diagram for the control circuits of the elevator;

FIG. 4 is a simplified wiring diagram of part of the presently preferred speed safety circuits.

The following is a list of the names of the electromagnetic switches shown in the drawing. Listed adjacent these names are reference characters utilized throughout the specification and in the drawing to identify the actuating coils of the respective switches.

| | |
|---|---|
| 1C, 2C, 3C, TC | CAR CALL REGISTRATION SWITCHES* |
| 1FL, 2FL, 3FL, TFL | LANDING SWITCHES* |
| 1U, 2U, 2D, 3U, 3D, TD | HALL CALL REGISTRATION SWITCHES* |
| D | DOWN DIRECTION SWITCH |
| EV | EVEN FLOOR SWITCH |
| HX | AUXILIARY MAIN RUNNING SWITCH |
| KLS | AUXILIARY SAFETY SWITCH |
| KLX | SPEED MEMORY SWITCH |
| LVA | LEVELING APPROACH SWITCH |
| MS | MAIN SAFETY SWITCH |
| NT | HALL TIME SWITCH |
| OD | ODD FLOOR SWITCH |
| RL | RELEVELING SWITCH |
| RLX | AUXILIARY RELEVELING SWITCH |
| S | START STOP CONTROL SWITCH* |
| ST | TIMED START SWITCH |
| U | UP DIRECTION SWITCH |
| XD | AUXILIARY DOWN DIRECTION SWITCH |
| XU | AUXILIARY UP DIRECTION SWITCH |
| Z | ZONE SWITCH* |

Switches designated with an asterisk (*) are of the latching type, their reset coils being distinguished from their actuating coils by adding the suffix letter (*r*) to the previously listed reference characters used to identify their respective actuating coils.

Prefix numerals included in certain of the above and other reference characters employed in this application indicate the individual landings with which the equipment identified by those reference characters is associated. The prefix letter T indicates that the equipment with which it is used in associated with the top landing.

Mechanically and magnetically actuated switches shown on the drawing are designated as follows:

| | |
|---|---|
| EM | EVEN INDUCTOR SWITCH |
| LVD | DOWN LEVELING SWITCH |
| LVU | UP LEVELING SWITCH |
| O | ODD INDUCTOR SWITCH |

Numerical suffixes are appended to the reference characters for all of the above switches in both the specification and drawing to identify the contacts of the respective switches.

Electromagnetic switches are shown in the deenergized and reset states while the mechanically and magnetically actuated switches are illustrated in the unoperated state.

Resistors, capacitators and rectifiers are identified in the drawing by the reference characters R, C, and CR respectively. Appropriate suffix numerals are appended to these characters to differentiate one element from another.

It is to be understood that to facilitate the disclosure of the invention it is illustrated in a system which is much simpler than would be found in a commercial installation.

Referring to FIG. 1 of the drawing, elevator car CA and counterweight CW are suspended in typical fashion from hoist ropes HR which pass over sheave TS to be driven thereby when hoist motor M rotates the sheave. A magnetic sensor MG is mounted in close proximity to a gear G which is mounted on a shaft directly driven by the hoist motor. The magnetic sensor MG responds to each passing gear tooth to provide a pulse representing each passing gear tooth, to a speed switch SS. Such magnetic sensors are known in the art and are commercially available; for example, Electro Corp. Model No. 3040A (Florida). Speed switch SS comprises a velocity sensing means which responds to pulses from the magnetic sensor MG having a repetition frequency greater than a predetermined frequency to transfer its movable contact SCP (FIG. 4) from its position 1 to its position 2. Accordingly, in the arrangement disclosed the velocity sensing means produces a low and high speed signal in response to the speed of the car being less than or in excess of a predetermined velocity. Speed switches of this type are known to the art and are available commercially; for example, Electro Corp. Model No. 55152 (Florida).

Odd and even inductor switches O and EM are mounted on the exterior of the car, so that each coacts with the appropriate odd and even group of vertically disposed floor vanes 1FVD, 2FVU, 2FVD, 3FVU, 3FVD and TFVU (FIG. 1) to operate contacts O1 and EM1, respectively (FIG. 3). Together these switches and vanes comprise part of the distance sensing means of the apparatus disclosed herein.

A different floor vane is provided for each direction in which the car can approach each landing. The vanes associated with the respective up and down directions are identified by the suffix letters U and D appended to their respective reference characters.

Each floor vane includes both inner and outer active sections separated by an inactive section. The associated inductor switch EM or O is activated and released to close and open contacts O1 and EM1 (FIG. 3) upon entering and leaving the zone of influence of each active section of each of its associated vanes. Each vane is so located in the hoistway with respect to its associated landing that its respective inductor switch leaves the zone of influence of its outer active section 1DO, 2UO, 2DO, etc. upon elevator car CA arriving at rated speed stopping distance from the landing in the direction associated with the respective floor vane. Entry into each outer active section occurs sufficiently in advance of the rated speed stopping distance to permit the operation of the circuitry of landing switches 1FL, 2FL, etc. (FIG. 3) in response to the activation of the respective inductor switches EM and O to produce the proper indications of the location of elevator car CA.

Inner active section 1DI, 2UI, 2DI, etc. are located in relation to their respective landings such that the associated odd and even inductor switches are operated by such sections whenever the car is located within a predetermined distance above or below any landing. The inner active sections provide a proper transition from main operation to leveling operation during deceleration. The latter operation is well-known and in the disclosed embodiment is provided in response to the cooperation of up and down leveling switches LVU and LVD mounted on car CA with the associated leveling cams 1LCU, 2LCU, 2LCD, etc. which are appropriately mounted in the hoistway. This equipment comprises a leveling means for controlling the final movement of the car in its approach to a stop at each landing until the car floor is in substantial register with such landings.

Referring to FIG. 2 a group of switch coils and contacts are shown connected between potential lines E1+ and HL1. Up and down hall call buttons 1SU, 2SU, 2SD, etc. and car call buttons 1SC, 2SC, etc. are shown connected in series with the set or activating coils 1U, 1C, 2U, etc. of respective hall and car call switches. The reset coils 1U*r*, 1C*r*, etc. of these switches are connected in series with contacts 1U1, 1C1, 2U1, etc. of these switches. Groups of the last mentioned contacts are further connected in series with contacts controlled by coils XU, XD and also with contacts 1FL1, 2FL1, 3FL1, TFL1, EV3 and OD3 of FIG. 3. The floor landing switches and the hall and car call switches operate contacts which together with contacts NT4, XU3, and XD3 allow operation of coils XU and XD. Also shown are contacts D2, U2, XD6, XU6 which allow only one out of the pairs of coils XU, XD, and U, D to operate. Coils U and D, which are associated with movement in the up or down direction are also controlled by the contacts U3, D3, XU5, XD5. They are also controlled by contacts LVA1 and also by the up and down leveling switches LVU, LVD which are described in connection with FIG. 1.

Contacts MS4 are in series with the circuits which include coils U and D. Accordingly, these contacts comprise part of a disabling means which can prevent energization of coils U and D. Contacts KLS1 also compirse part of the disabling means. They are connected in series with up and down leveling switches LVU and LVD, the latter, as previously mentioned, comprising a part of the leveling means. The parallel combination of contacts S7 and KLS2 is also serially connected with coils U and D. This latter combination also comprises part of the disabling means referred to as an inhibit means which prevents automatic movement in response to the operation of the start stop control switch if contacts KLS2 are welded closed.

Referring to FIG. 3 a plurality of coils Z, LVA, OD, EV are shown connected to receive power from line E1+. Coils 1FL, 1FL*r*, 2FL*r*, etc. are similarly connected and are controlled by contacts of the landing switches with which they are associated as well as contacts of the switches with which coils XU, XD and Z are associated. Contacts O1 and EM1 of the even and odd inductor switches which are responsive to the several floor vanes 1FVD, 2FVD, are connected in circuit with coil LVA. These inductor switch contacts, in combination with contacts Z2 and Z1, enable power to be applied to the series combination of the coil LVA, contacts S6, EV2, OD2. Coil LVA and contacts S6 comprise part of the distance sensing means which operates to produce a distance signal in response to each initiation of a stopping operation for each of the landings upon the car being located within a predetermined distance of the landing at which the stop is to be made.

Referring to FIG. 4, a group of coils HX, ST, RL, RLX, MS, KLX and KLS are connected to receive power from line E1+ through a manual means, namely manual switch RT located in the elevator machine room. The coil RL is in series with a parallel combination of contacts S8, and HX3, RLX1. The coil MS is in series with typical well-known safety devices SC and logic means LM. This latter equipment comprises the parallel combination of (a) contacts LVA3, RLX2 (b) contacts KLS3 and (c) contacts U6, D6. Coil MS is further in series with the parallel combination of contacts HX4, MS1 with contacts ST1. The coil KLX is in series with contacts HX5 and KLX1, the combination of these contacts and the coil providing a memory means. Contacts HX5 provide a reset means for terminating the self-holding features of coil KLX. The coil KLS is in series with the parallel combination of contacts KLX2 with LVA2 and KLS2. Coil KLS, as more fully described herein, comprises part of an auxiliary safety means with contacts LVA2 and KLS2 providing a self-holding feature.

Movable contacts SCP of the velocity sensing means SS changes from position 1 to position 2 when car velocity exceeds a predetermined velocity. It is arranged to connect coils KLS and KLX through switch RT to line E1+. The stationary contacts at positions 1 and 2 are connected to the circuits of the coils KLS and KLX, respectively.

Coil HX, of the auxiliary main running switch, is energized through either contacts U4 or D4. Coil HX can also be energized through contacts MS3 and HX1. This occurs if contacts U4 and D4 should remain closed after coil MS is deenergized. The energization of coil HX through contacts MS3 and HX1 is terminated by operation of manual switch RT to its inoperative state.

To facilitate an understanding of the preferred embodiment its operation will be described first under conditions judged to be consistent with continued safe operation and then under conditions judged to be inconsistent therewith. In describing the first of the above two sets of conditions, coil MS (FIG. 4) of the main safety switch will remain energized while the car CA is performing an interfloor run. The subsequent description of performance under the latter of the above two sets of conditions will describe operations of the car in which the coil of the main safety switch will be deenergized and the switch released.

Accordingly, assume that elevator car CA is at rest at the first landing. In these circumstances, movable contact SCP (FIG. 4) is in position 1, indicating car velocity less than a predetermined velocity. Coil MS is energized causing the main safety switch to be in its operated state. The energization circuit for coil MS is through closed contacts U6, D6, ST1 and the typical safety devices SC. Contacts ST1 are closed as a result of coil ST of the timed start switch being energized and the switch being operated. These conditions prevail because as the car stopped at the first landing its auxiliary main running switch (coil HX, FIG. 4) was released to open its contact HX4 and deenergize coil MS. This released the main safety switch which closed its contacts MS2 to complete an energizing circuit through closed switch RT and closed contacts U5, D5, HX2, and MS2 to coil ST of the timed start switch. This operates the switch which closes contacts ST2 making it self-holding and contacts ST1 causing the above described energization of coil MS.

In addition, as has been explained, odd inductor switch O is in the zone of influence of inner active section 1DI of first landing vane 1FVD and consequently contacts O1 are engaged. As a result, as will be understood from later description, coil LVA (FIG. 3) is energized through closed contacts O1, Z2, OD2, EV2 and S6. Thus the leveling approach switch is operated and its contacts LVA2 (FIG. 4) are closed providing an energizing circuit for coil KLS through those contacts and contacts KLS2. The auxiliary safety switch is thereby operated to close its normally open contacts and open its normally closed ones. Also, first landing switch (coil 1FL, FIG. 3) is in the set condition, its set coil having been the last of its two coils to be energized. The zone switch (coil Z, FIG. 3), the start-stop control switch (coil S, FIG. 2), the other landing switches (coils 2FL, 3FL, TFL, FIG. 2) and the call registration switches (coils 1U, 1C, 2U, etc. FIG. 2) are in the reset state, their reset coils being the last of their two coils to be energized. All other switches not specifically referred to above are in their unoperated states.

Further assume a hall call has just been registered by an intending passenger pressing hall call button 3SU (FIG. 2) causing the energization of the upper or set coil 3U through the completed circuit from line E1+ to line HL1.

In response to the energization of coil 3U, the third floor up hall call registration switch is operated and and closes contacts 3U3. Coil XU (FIG. 2) is energized through closed contacts MS4, NT4, 3U3, rectifier CR2, contacts 3FL4, TFL2, and XD6. This results in the operation of the auxiliary up direction switch and the closing of contacts XU1. As a result coil S is energized through contacts MS4, NT2 and XU1 (FIG. 2). This transfers the start-stop control switch to its set state and contacts S6 (FIG. 3) open interrupting the energizing circuit of coil LVA. As a result the leveling approach switch releases to restore its contacts to their normal condition including contacts LVA2 (FIG. 4) which open to interrupt the circuit of coil KLS of the auxiliary safety switch which also releases to restore its contacts to their normal condition.

In the meantime the remainder of the normally closed contacts of the start-stop control switch disengage and the normally open contacts engage. Included in the latter are contacts S8 (FIG. 4) which in closing complete an energizing circuit for coil RL which operates the releveling switch causing it to close its contacts RL1. This engergizes coil RLX to operate the auxiliary releveling switch and close contacts RLX2 which in combination with closed contacts LVA3 provide an alternative path to contacts U5 and D6 for coil MS.

The operation of the start-stop switch also closes contacts S1 which completes an energizing circuit for coil U (FIG. 2) through closed contacts MS4, S1, XU5, D2, and KLS2. This causes the operation of the up direction switch which closes its normally open contacts and opens its normally closed contacts. In closing, contacts U1 provide an energization circuit for coil NT through closed contacts MS4 and U1 (FIG. 2). As a result the hall time switch operates to open contacts NT2 which interrupts the energizing circuit of set coil S of the start-stop switch without effect. The start-stop switch remains in its engaged or set condition until its reset coil S*r* is energized. The energization of this coil U closes contacts U4, thereby operating the auxiliary main running switch. This causes the engagement of the normally open contacts of this switch and the disengagement of its normally closed contacts. The closing of contacts HX3 provide a circuit with closed contacts RLX1 for maintaining coil RL energized when contacts S8 open. Contacts HX4 with closed contacts MS1 provide a circuit for maintaining coil MS energized when contacts ST1 open.

The actuation of the up direction switch (coil U) in conjunction with the actuation of the start-stop control switch (coil S) also is utilized to start and accelerate elevator car CA in the up direction in any well-known manner.

As an example of the manner in which the up direction switch and the start-stop control switch may be utilized to start elevator car CA, assume car CA is installed in a system in which it is driven by a motor control system including a d.c. hoisting motor arranged in a Ward Leonard system with a self-excited d.g. generator. As is well-known, contacts of the up direction and start-stop control switch are employed in such a system to actuate accelerating switches, the operation of which control the amount of current that flows in the generator's shunt field winding to start and accelerate the car.

Alternatively, elevator car CA may be installed in a system in which it is driven by a motor control system including an a.c. motor of the well-known type in which contacts of the up direction and start-stop switch are employed to apply a step input voltage to the input of a pattern generator which will start and accelerate the car. An example of such a motor control system is that disclosed in U.S. Pat. No. 3,678,355.

As the car CA is accelerated upwardly from the first floor, movable contact SCP (FIG. 4) changes from position 1 to position 2 when the car CA velocity exceeds a predetermined velocity which in the preferred embodiment occurs around ½ meter/second. This speed is considerably less than the typical rated speed of the elevator for interfloor trips.

When contact SCP moves to position 2 coil KLX is energized. This operates the speed memory switch and it closes its normally open contacts and opens the normally closed ones. In closing, contacts KLX1 together with closed contacts HX5 provide a circuit for maintaining coil KLX energized when contact SCP returns to position 1. As a result this circuitry retains a memory of the car CA having exceeded a velocity of ½ meter/-second during each run until the car comes to rest and the auxiliary main running switch releases to open contacts HX5 in the manner to be described.

As the car CA continues and approaches the second floor, the even floor inductor switch EM eventually enters into the zone of influence of outer active section 2UO of even floor vane 2FVU causing contacts EM1 (FIG. 3) to close. This completes a circuit to the set coil 2FL of the second landing switch (FIG. 3) through contacts EM1, XU9 and 1FL5. As a result second landing switch operates to its set condition signifying that the car is approaching the second landing. Simultaneously, a circuit is also completed to the coil EV of the even floor switch (FIG. 3) through closed contacts EM1 and Z6. Upon this switch transferring to its actuated state contacts EV5 close to energize the set coil Z of the zone switch (FIG. 3) through those closed contacts and contacts EM1. Operating the zone switch to its set condition closes contacts Z3 and completes the circuit to reset coil 1FL*r* of the first landing switch (FIG. 3) through contacts EM1, Z3, 1FL3. This operates the first landing switch to its reset condition and that together with the previously described operation of the second landing switch to its set condition completes the transfer of the indicated location of the car from the first landing to the second.

From the foregoing, it will be appreciated that the landing switches (coils 1FL, 2FL, 3FL and TFL of FIG. 3) are sequentially actuated in response to the even and odd inductor switches EM and O encountering the outer active sections of the several associated floor vanes. Thus when switch O encounters the outer active section 3UO while approaching the third landing, coil 3FL of FIG. 3 will be energized through closed contacts O1, XU7 and 2FL5 to operate the third floor landing switch to its set condition.

It should also be appreciated from the above description of the travel of the car CA to the second landing, that the zone switch alternates between its set and reset states in response to the inductor switches encountering the outer active sections 2UO, 3UO, etc. (FIG. 1). Thus, when contacts O1 of the odd inductor switch O close upon it encountering section 3UO coil OD is energized through closed contacts 01 and Z7. This operates the odd landing switches to close its normally open contacts and open its normally closed contacts. As a result reset coil Z*r* of the zone switch is energized through contacts OD5, Z5, and O1 (FIG. 3) to operate that switch to its reset condition in preparation for any subsequent approach of the car to an even landing. The operation of the zone switch to its reset condition transfers its normally open contacts to their normally open condition and its normally closed contacts to their normally closed condition. Reset coil 2FL*r* of the second landing switch is thereby energized through closed contacts O1, Z4 and 2FL3 to operate the switch to its reset condition. This in conjunction with the operation of the third landing switch to its set condition signifies the location of the car as being at the third landing. As a result, reset coil S*r* (FIG. 2) of the start-stop control switch is energized through contacts OD3, 3FL1, XD2 and 3U1 and the reset coil 3U*r* of the third landing up hall call switch. This operates the start-stop control switch to its reset condition and in a well-known manner causes either of the suitable previously mentioned motor control systems to decelerate the elevator car. Also, the energization of reset coil 3U*r* operates the third landing up hall call switch to its reset condition effectively cancelling the registration of the call.

In addition to causing the initiation of the deceleration of the car, the operation of the start-stop control switch to its reset condition also restores the switch's normally open and normally closed contacts to their normal conditions.

As the elevator car decelerates its velocity decreases below ½ meter/second and switch SS causes movable contacts SCP (FIG. 4) to return to position 1 thereby energizing coil KLS through closed contacts KLX2. This operates the auxillary safety switch to close its normally open contacts and open its normally closed ones. For example, contacts KLS2 (FIG. 2) open without effect since contacts S7 have closed. Also contacts KLS3 (FIG. 4) close to provide a circuit for coil MS of the main safety switch when contacts LVA3 open in response to the release of the leveling approach switch which is explained hereinafter.

As car CA continues its decelerating approach toward the third floor, it eventually enters the zone of influence of inner active section 3UI (FIG. 1) of floor vane 3FVU. Odd floor inductor O1 is actuated and closes contacts O1 (FIG. 3) to complete a circuit to the coil LVA of the leveling approach switch through the additionally closed contacts Z2, OD2, EV2 and S6. Upon encountering the inner active section 3UI the odd landing switch is not operated in response to the closing of contacts O1 because contacts Z7 are open in the circuit of coil OD since the zone switch is in its reset condition. Thus coil LVA is energized in response to the start-stop control switch being operated to its reset state, signifying the initiation of a stopping operation for the landing, and the car CA entering to within a predetermined distance of the desired landing, as indicated by the closing of contacts O1 upon the odd inductor switch encountering the inner active section 3UI of vane 3FVU. The energization of coil LVA operates the leveling approach switch to cause its normally open contacts to close and its normally closed contacts to open.

Just prior to the leveling approach switch being operated, up leveling switch LVU (FIGS. 1 and 2) engages third landing up leveling cam 3LCU (FIG. 1) causing the switch to close. This continues to energize coil U of the up direction switch through the circuit including closed switch LVU and contacts KLS1 (FIG. 2). Switch LVU enables the car to operate at leveling speed in any well-known manner until it is in register with the third landing at which location up leveling switch LVU is disengaged from up leveling cam 3LCU and car CA is suitably stopped as a result of the deenergization of coil U (FIG. 2) and the release of the up direction switch. As a result of the release of the up direction switch, coils HX, RL and RLX (FIG. 4) are deenergized upon the sequential opening of contacts U4, HX3, RL1, respectively. As a result, the auxiliary main sensing switch, the releveling switch and the auxiliary releveling switch are operated to their released conditions. The release of the auxiliary main running switch as explained earlier, opens contacts HX4 causing the deenergization of coil MS and the release of the main safety switch. With its release contacts MS2 close to energize coil ST of the timed start switch to operate that switch to close its contacts ST1 and ST2. As described earlier, this results in the restoration of the main safety switch to its operated condition and the system is in condition to operate car CA in response to additional calls.

The foregoing describes the normal operation of the elevator system under conditions judged to be consistent with continued safe operation. The remainder of the description concerns the response of the preferred embodiment under conditions judged to be inconsistent with continued safe operations.

Consider first the situation where the car CA has accelerated from the first floor according to above description, but in contrast therewith fails to decelerate as rapidly as intended as it approaches the third floor. In such a situation that part of the disabling means of the invention comprising logic means LM and the main safety switch (coil MS, FIG. 4) will respond to prevent automatic movement when the car CA enters the zone of influence of inner active section 3UI.

As described previously, after the release of the start stop control switch initiates a stopping operation for the third landing, the entrance of the car into the zone of influence of the inner active section 3UI energizes coil LVA (FIG. 3) through closed contacts O1, Z2, OD2, EV2 and S6. This signifies the entrance of car CA to within a predetermined distance of a landing for which a stop is being made.

If at the time the car CA has not decelerated as rapidly as intended, the speed of the car CA is not below ½ meter/second and the velocity sensing means SS has not restored its movable contact SCP to position 1. As a consequence coil KLS (FIG. 4) is not energized and the auxiliary safety switch is not operated. Contacts KLS3 (FIG. 4) of the logic means LM are open signifying the speed of the car CA is in excess of ½ meters/-second. The opening of contacts LVA3 in response to the operation of the leveling approach switch therefor, interrupts the only remaining circuit of logic means LM by which coil MS can remain energized. The deenergization of coil MS releases the main safety switch to open contacts MS4.

Contacts MS4 (FIG. 2) are in series with coils XU, XD, U and D. Accordingly, when contacts MS4 open under the foregoing circumstances, the energization circuits for all of the last mentioned coils are interrupted and until contacts MS4 are reclosed none of the associated switches can be operated to their actuated condition. As long as this condition in which neither the up nor the down direction switch can be actuated automatically, the control apparatus which moves the car automatically is rendered inoperable.

When coil MS is deenergized in the foregoing manner the auxiliary main running switch (coil HX, FIG. 4) of the preferred embodiment remains energized to prevent the automatic reenergization of coil MS. When coil MS is deenergized to release the main safety switch as described, contacts MS3 (FIG. 4) close and complete a circuit to coil HX through manual switch RT and contacts MS3 and HX1. Coil HX will remain so energized as long as manual switch RT remains closed. Since coil HX is energized the auxiliary main running switch is operated to open contacts HX2 (FIG. 4). This prevents coil ST from being energized. As a result the timed start switch cannot operate to close contacts ST1 and coil MS cannot be energized. The main safety switch therefore is maintained in its released condition and contact MS4 remains open rendering the control apparatus inoperable to move the elevator car CA automatically.

The elevator control apparatus can be restored to operable condition to render the car CA capable of automatic movement again by the operation of manual switch RT. Upon the operation of switch RT to open its contacts, coil HX of the auxiliary main running switch will be deenergized and the switch will release. This will cause contacts HX1 to open and contacts HX2 to close. Consequently, upon the subsequent release of switch RT and the reclosing of its contacts coil HX will not be reenergized and coil ST will be energized. The energization of coil ST, as explained earlier, will result in the operation of the timed start switch and the consequent operation of the main safety switch to close its normally open contacts and open its normally closed ones whereupon automatic movement is again possible.

Obviously there are alternative ways of performing this restoration. In accordance with the presently preferred embodiment manual switch RT is provided in the elevator machine room with the intention that only authorized individuals will be able to restore service after such an operation of the safety arrangement of the invention. It will be apparent that commercial practices can vary and that alternative arrangements for restoring automatic movement will not be outside the scope of the invention.

It has just been explained how the failure of the auxiliary safety switch to operate in a particular situation deenergizes coil MS and prevents automatic movement of the elevator car. In that particular situation the auxiliary safety switch also operates to prevent automatic movement by interrupting the energizing circuit of coil U directly. As previously explained, when the car enters the zone of influence of inner active section 3UI, coil U (FIG. 2) is energized through up leveling switch LVU. This constitutes the only circuit path for coil U since contacts S1 and LVA1 are open. Accordingly, failure of the auxiliary safety switch to operate to close contacts KLS1 in the foregoing situation prevents the circuit of the up leveling switch from maintaining coil U energized. As a result the leveling means of the control apparatus is rendered inoperable. It is to be realized that contacts KLS1 are not required to prevent automatic movement under these circumstances. However, since coil U is independently disabled by contacts KLS1 these contacts provide redundancy for contacts MS4 of the main safety switch in the particular situation under discussion.

The foregoing explained how the logic means LM and contacts KLS1 prevents automatic movement when the car fails to decelerate as rapidly as intended and car CA enters the zone of influence of inner active section 3UI travelling in excess of a predetermined velocity. It will be readily apparent, however, that automatic movement will be prevented in a similar fashion if the car CA stops at the third landing as intended but subsequently accelerates to a velocity in excess of a predetermined velocity although the start-stop control switch remains in its reset state. Logic means LM and contacts KLS1 again prevent automatic movement upon the car exceeding a predetermined velocity as described above.

The preferred embodiment is also effective to prevent automatic movement in other situations. In order to understand another of these situations, assume that velocity sensing means SS never operates to transfer movable contact SCP from position 1 to position 2 during the previously described operation of car CA. As a result the memory means comprising speed memory switch (coil KLX, FIG. 4) is not operated in the manner previously disclosed. Consequently, contacts KLX2 remain open throughout the operation of the car CA and the auxiliary safety switch (coil KLS, FIG. 4) is not operated to close contacts KLS3 (FIG. 4). As previously explained the failure of these contacts to close causes the release of the main safety switch to prevent further automatic movement of car CA upon the generation of the distance signal, signified by the actuation of the leveling approach switch (coil LVA, FIG. 3).

The preferred embodiment also operates to prevent further automatic movement of car CA should the auxiliary safety switch (coil KLS, FIG. 4) fail to release as intended. Thus, if the start-stop control switch transfers to its set condition in an attempt to initiate the start of the car CA contacts KLS2 (FIG. 2) remain open and the energizing circuits of coils U and D are interrupted.

In this regard, as previously explained, coil KLS (FIG. 4) of the auxiliary safety switch is deenergized as a consequence of the setting of the start-stop control switch. Should a malfunction such as the welding of contacts of the auxiliary safety switch prevent contacts KLS2 from closing upon the release of that switch in response to the setting of the start-stop control switch, contacts S7 and KLS2 are both open and function as an inhibit means preventing the energization of coil U (FIG. 2) contrary to the foregoing description of normal operation. Accordingly, automatic movement of the car CA is prevented.

Various modifications to the foregoing arrangement will be evident to those skilled in the art and for that reason it is intended that the arrangement be considered illustrative only and not limiting in any sense.

What is claimed is:

1. In an elevator system having control apparatus by which an elevator car is moved automatically between a plurality of landings and is stopped automatically at any one of said plurality of landings upon initiation of a stopping operation for each respective landing, a safety arrangement comprising:

velocity sensing means producing at least a low and high speed signal in response to the speed of the car being less than or in excess of a predetermined velocity, respectively;

distance sensing means operating to produce a distance signal in response to each initiation of a stopping operation for each of said landings upon the car being located within a predetermined distance of the landing at which the stop is to be made; and disabling means including memory means having first and second state and being operable from said first state to said second state in response to said high speed signal, and remaining in said second state after said high speed signal ceases, and logic means actuated in response to the production of said distance signal and said memory means being in said first state, said disabling means rendering said control apparatus inoperable if during automatic movement between landings said velocity sensing means does not produce a high speed signal.

2. In an elevator system according to claim 1, wherein said logic means comprises:

auxiliary safety means having first and second states and transferring into said second state in response to the production of said low speed signal when said memory means is in said second state;

main safety means rendering said control apparatus inoperable in response to said distance signal being produced when said auxiliary safety means is in said first state.

3. In an elevator system according to claim 2, said elevator control apparatus including start means generating a start signal for initiating movement of said car from a starting landing toward a landing at which a stopping operation is to be performed, said disabling means further including:

inhibit means responsive to said start means and said auxiliary safety means for rendering said control apparatus inoperable so that said car cannot leave said starting landing in response to said start signal being generated when said auxiliary safety means is simultaneously in said second state.

4. In an elevator system according to claim 3, said disabling means including:

reset means transferring said memory means into said first state after said auxiliary safety means has transferred to said second state.

5. In an elevator system having control apparatus by which an elevator car is moved automatically to and is stopped automatically at any one of a plurality of landings upon the initiation of a stopping operation for each respective landing, a safety arrangement comprising:

a velocity sensing switch being alternatively in a first and second state in response to the speed of the car being less than and in excess of a predetermined velocity, respectively;

distance sensing means operating to produce a distance signal in response to each initiation of a stopping operation for each of said landings upon the car being located within a predetermined distance of the landing at which the stop is to be made;

memory means having first and second states and transferring from said first to said second state in response to said velocity sensing switch being in said second state, said memory means upon operating to said second state remaining therein regardless of the state of said velocity sensing switch;

reset means for transferring said memory means into said first state when said car stops;

auxiliary safety means having first and second states and transferring to said second state in response to said velocity sensing means and said memory means being in said first and second states respectively, said auxiliary safety means returning to said first state upon the termination of the stopping operation by commencement of automatic movement to a different one of said plurality of landings;

main safety means for rendering said control apparatus inoperable to move said car automatically in response to said distance signal being produced with said auxiliary safety means being in said first state; and a manual switch coupled to said main safety means and manually operable from a first to a second position to remove power from portions of said disabling means, said main safety means upon operation, maintaining said control apparatus inoperative until said reset switch is moved from said first to said second position and back to said first position.

* * * * *